US006748842B1

(12) United States Patent
Guirguis

(10) Patent No.: US 6,748,842 B1
(45) Date of Patent: Jun. 15, 2004

(54) DARTS CONTAINING EXPLOSIVES FOR DEFEATING BURIED MINES

(75) Inventor: Raafat H. Guirguis, Fairfax, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 9 days.

(21) Appl. No.: 10/436,604

(22) Filed: May 9, 2003

(51) Int. Cl.[7] ..... F42B 33/06

(52) U.S. Cl. ..... 89/1.13; 86/50; 102/402; 588/202

(58) Field of Search ..... 89/1.13; 86/50; 102/402, 403; 588/202

(56) References Cited

U.S. PATENT DOCUMENTS

| | | | | |
|---|---|---|---|---|
| 4,169,403 A | * | 10/1979 | Hanson | |
| 6,232,519 B1 | * | 5/2001 | Eidelman et al. | 588/202 |
| 6,298,763 B1 | * | 10/2001 | Greenfield et al. | 89/1.13 |
| 6,308,607 B1 | * | 10/2001 | Woodall et al. | 89/1.13 |
| 6,401,591 B1 | | 6/2002 | Ross et al. | 89/1.13 |
| 6,439,127 B1 | * | 8/2002 | Cherry | 102/402 |
| 6,540,175 B1 | | 4/2003 | Mayersak et al. | 244/3.15 |

FOREIGN PATENT DOCUMENTS

| | | | |
|---|---|---|---|
| DE | 39 37 464 A1 | * | 5/1991 |
| GB | 2 259 971 A | * | 3/1993 |

* cited by examiner

*Primary Examiner*—Stephen M. Johnson
(74) *Attorney, Agent, or Firm*—Mark Homer

(57) ABSTRACT

The invention, as embodied herein, comprises a kinetic energy driven projectile for defeating unexploded ordnance or buried land mines. This projectile has been developed to address the specific problem with similar devices in that the kinetic energy by itself does not sufficiently fracture the explosive material within a mine in order to fully defeat the mine.

This invention adds a small amount of insensitive high explosive material but that is cap sensitive to one tip of the projectile, along with a novel initiation mechanism, so that the detonation of the high explosive material can more fully fracture the explosive material within a mine. This allows a neutralization agent to completely react with all of the explosive material within the mine, thereby consuming the entire fill.

9 Claims, 4 Drawing Sheets

DARTS CONTAINING EXPLOSIVES FOR DEFEATING BURIED MINES

STATEMENT OF GOVERNMENT INTEREST

The invention described herein may be manufactured and used by or for the Government of the United States of America for governmental purposes without payment of any royalties thereon or therefor.

BACKGROUND OF THE INVENTION

1. Field of the Invention

This invention relates in general to devices used to defeat or render safe unexploded ordnance or buried land mines, more specifically to kinetic energy penetrating devices that defeat such mines, and most specifically to kinetic energy penetrating devices that contain materials that neutralize the explosive material within such mines.

2. Description of the Related Art

Over the past several years, several systems have been developed that employ penetrating devices to defeat unexploded ordnance and/or buried land mines. Particularly pertinent to the invention are darts or projectiles designed to penetrate through dirt, sand, and/or water as well as the casing of unexploded ordnance or buried land mines in order to deliver a payload designed to neutralize the explosive material within said mines. In operation, the devices are designed to penetrate through the casing of a mine and use kinetic energy to "break-up" or fracture the explosive material within a mine, allowing a neutralizing agent to contact the fractured explosive material, thereby neutralizing it. The neutralizing agent is normally some type of material that will burn the explosive material in the mine but not detonate it, for example, the hot decomposition products of a propellant, or chemically react with the explosive in the mine in order to complete its neutralization.

Examples of such systems and devices include U.S. Pat. No. 6,401,591 that discloses a projectile that carries a surface contact chemical capable of neutralizing explosives wherein the nose assembly penetrates the casing of a mine and fractures the explosive material, while separating from remainder of the projectile, allowing the surface contact chemical to react with the fractured explosive within the mine. U.S. Pat. No. 6,540,175 discloses a projectile having a cavitating nose and carrying a high temperature incendiary fill to burn explosive material with a mine.

However, the neutralizing agents used in the above devices only react with the exposed surface area of the explosive material within a mine. Therefore, in order to completely consume or defeat all of the explosive material within a mine, the explosive material must be extensively fractured to greatly increase the surface area that reacts with the neutralizing agent. It has been determined through testing that often, that kinetic energy penetration alone does not sufficiently fracture the explosive material within a mine to allow the explosive material to be fully consumed by the neutralizing agent.

Therefore, it is desired to develop a method to increase the level of fracture of explosive material within a mine so that a delivered neutralizing agent may fully consume said explosive material, completely defeating the mine without initiating a detonation in said explosive material.

SUMMARY OF THE INVENTION

The invention proposed herein comprises a kinetic energy penetrating projectile to defeat buried mines containing a small amount of a high explosive material capable of detonation in order to extensively fracture the explosive material within the mine so that a neutralizing agent can fully defeat the mine without detonating it.

Accordingly, it is an object of this invention to provide a projectile to defeat mines without detonating the mines.

It is a further object of this invention to provide a projectile that significantly fractures the explosive material within a mine so that it can be fully neutralized.

This invention meets these and other objectives related to defeating buried mines by providing a projectile containing either a neutralizing agent or a material that generates a neutralizing agent on one end and a small amount of a high explosive capable of detonation on the opposite end. A detonator is placed proximate to the high explosive material with a backstop being placed proximate to the detonator. In operation, the projectile penetrates the casing of the mine and penetrates into the explosive material within the mine, beginning to fracture the explosive material. Initiation of the high explosive material is delayed until deceleration of the projectile causes the high explosive material to push into the detonator, which in turn, pushes against the backstop and activates the detonator. The detonator initiates a detonation in the high explosive material, causing extensive fracture/damage of the explosive material within the mine. This allows the neutralizing agent to completely consume the explosive material within the mine, thus defeating the mine without detonating it.

BRIEF DESCRIPTION OF THE DRAWINGS

The accompanying drawings, which are incorporated in and constitute a part of the specification, illustrate embodiments of the invention, and, together with the description, serve to explain the principles of the invention.

DESCRIPTION OF THE PREFERRED EMBODIMENT

The invention, as embodied herein, comprises a kinetic energy driven projectile for defeating unexploded ordnance or buried land mines. This projectile has been developed to address the specific problem with similar devices in that the kinetic energy by itself does not sufficiently fracture the explosive material within a mine in order to fully defeat the mine.

This invention adds a small amount of an insensitive high explosive material to one tip of the projectile, along with a novel initiation mechanism, so that upon its detonation, the high explosive can fully fracture the explosive material within a mine. This allows the neutralization agent contained or generated by the materials within the remainder of the projectile to completely react with all of the explosive material within the mine, thereby consuming the entire fill.

Figure 1A:
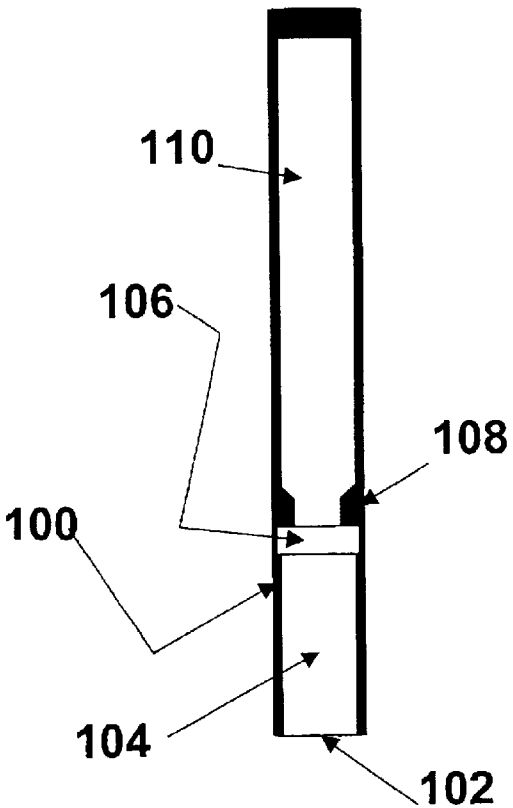
FIG. 1*a* is an embodiment of the present invention.
Figure 1B:
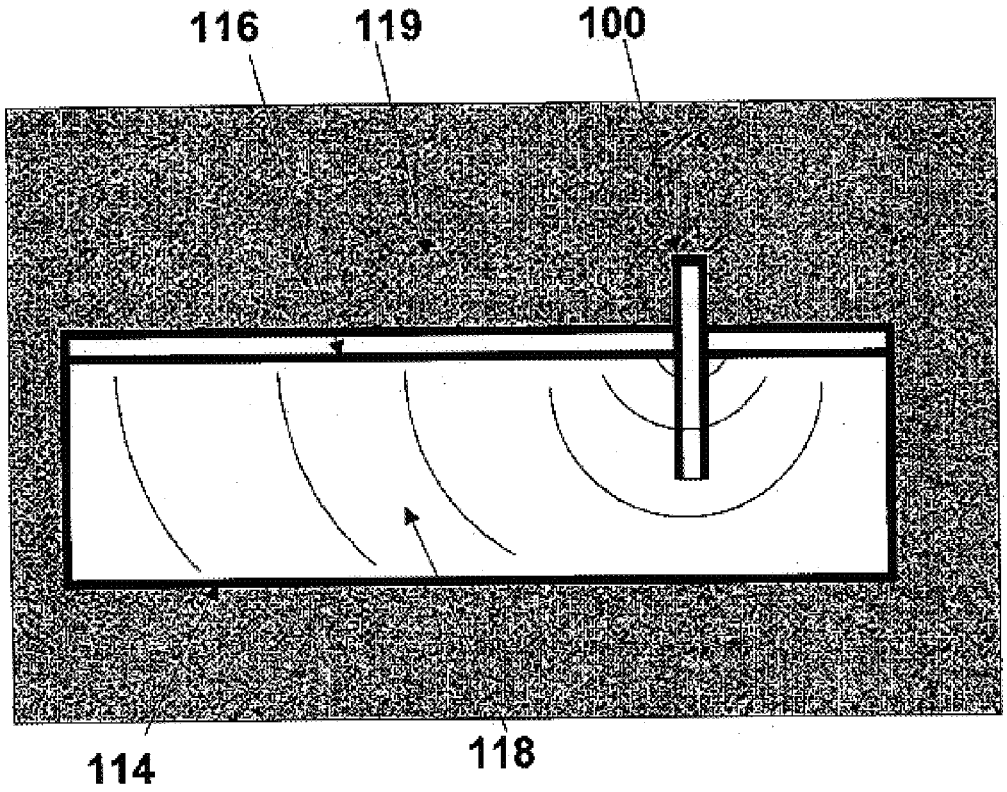
FIG. 1*b* is the embodiment of the invention shown in FIG. 1 employed in a mine.

Referring to FIGS. 1*a* and 1*b*, the invention comprises a projectile having an elongated body 100 in the shape of a projectile or dart. The tip 102 of the elongated body 100 will be shaped so that the projectile can penetrate sand, dirt, water or other debris 119 used to bury a land mine, as well as standard land mine casing material. Such configurations include a cavitating or blunt tip as disclosed in U.S. Pat. Nos.

6,401,591 and 6,540,175 which are incorporated by reference herein. The body 100 can also include fins or other stabilization elements known in the projectile arts. An explosive 104 is located at one end of the body 100 with a detonator 106, including a primer/detonator, located proximate to the explosive 104. A backstop 108 is located proximate to the detonator 106 so that the detonator 106 is between the backstop 108 and the explosive 104. An explosive material neutralization agent 110 is located between the backstop 108 and the other end of the body 100.

In operation, the embodiment of the invention shown in FIGS. 1*a* and 1*b* penetrates through natural material 112, which may include sand, water, dirt, or a combination thereof, with the portion of body 100 containing the explosive material 104 further penetrating into a mine 114, through the mine casing 116 and into the mine explosive 118. The mine explosive 118 will be slightly fractured by the kinetic penetration of the projectile. The deceleration of the projectile due to the impact with the mine explosive 118 will push the explosive material 104 back into the detonator 106 and the backstop 108. The resulting pressure of "squeezing" the detonator 106 between the explosive material 104 and the backstop 108 will activate the detonator 106. In turn, this will initiate a detonation into the high explosive 104, enough energy to completely fracture all of the mine explosive 118. This will allow the neutralization agent 110 to fully react with the mine explosive 118, defeating the mine 114 without causing an explosion.

The body 100 of the projectile can be made of numerous materials selected by those skilled in the art. Preferred materials will provide sufficient strength and rigidity to allow penetrating through the mine casing 116. Preferred examples of such materials include steels and other metal alloys. The size of the body 100 will depend upon the size of the mine 114 one is trying to defeat and the placement of said mine 114. Preferred sizes for the body 100 range from 3–6" long and ⅜ to ⅝" in diameter.

The high explosive material 104 may also be selected by one skilled in the art in order to ensure that it is capable of fully fracturing the mine explosive 118 without detonating it. Examples of explosive 118 are TNT and Comp B. Therefore, preferred explosive materials 104 loaded within mine-defeating projectiles will be insensitive explosives, in order to minimize the hazard of carrying a large number of said projectiles, but explosives that are cap sensitive so that no booster will be required, and that produce a moderate yield such as to fracture the explosive 118 but not detonate it. Moreover, the amount of the high explosive 104 can be adjusted to achieve the proper balance between energy required to fracture the explosive 118 but not detonate it. A preferred example of such an insensitive explosives includes PBXW-128 composed of 77% fine HMX and 23% HTPB binder. The amount of explosive material 104 used will be dependent upon the size of the projectile and the size of the mine 114 one is trying to defeat. In conjunction with the preferred body 100 size noted above, preferred amounts of explosive material 104 range from about 1.5 to about 2 grains.

The detonator 106 will be a combined detonator and primer, generally used in the art to detonate insensitive explosives. Examples of such a detonator range from RP-3 containing 30 mg of PETN to RP-80 containing 80 mg of PETN and 123 mg of RDX. The backstop 108 is merely a physical structure that is capable of stopping the movement of the detonator 106 and explosive material 104 due to deceleration. The embodiment shown in FIG. 1*a* are two tabs or alternatively, a circular tab extending from an inner surface of the body 100.

The explosive material neutralization agent 110 may comprise any material that will react with the mine explosive 118 to defeat said mine explosive 118 without causing detonation. Preferred examples of neutralization agents 110 include pyrotechnic mix materials that will burn and consume the mine explosive 118, such as a high temperature incendiary fill or surface contact chemicals such as potassium hydroxide, diethylene triamine, diethylzinc, bromine trifluouride, and diethylenetriamine. Further examples of such agents can be found in U.S. Pat. Nos. 6,401,591 and 6,540,175.

Figure 2A:
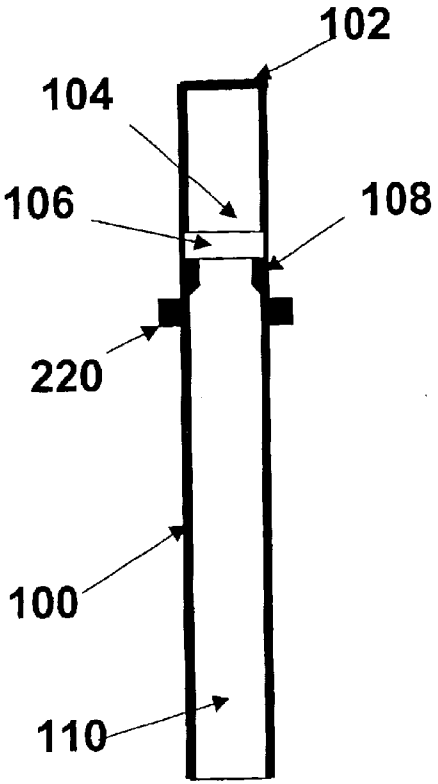
FIG. 2*a* is a second embodiment of the invention.
Figure 2B:
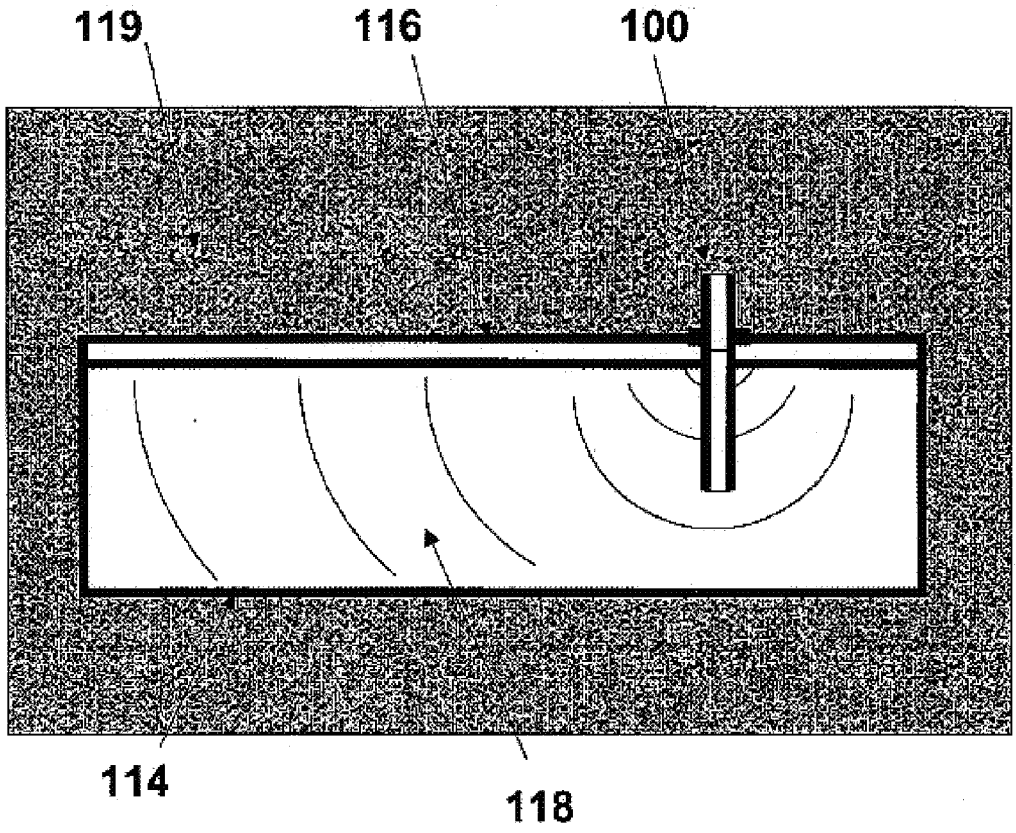
FIG. 2*b* is the embodiment of the invention shown if FIG. 2 employed in a mine.

Referring to FIGS. 2*a* and 2*b*, a second embodiment of the invention is depicted. In this embodiment, the explosive material 104 is located at the end of the body 100 opposite of where the projectile penetrates the mine 114. This embodiment includes all of the elements of the embodiment described above and also includes a location sensing means 220 that is located proximate to the backstop 108 on the outer surface of the projectile.

In operation, the projectile penetrates the mine casing 116, as above, but the penetration is stopped by the location sensing means 220, leaving the portion of the body 100 having the explosive material 104 therein outside the mine casing 116. Due to the deceleration caused by the location sensing means 220, the detonator 106 is activated due to being "squeezed" between the backstop 108 and the explosive material 104, detonating the explosive material 104. This detonation sends waves through the mine explosive 118, fully fracturing said mine explosive 118, and allowing the explosive material neutralization agent 110 to fully react with the mine explosive 118. This embodiment is less likely to cause detonation of the mine explosive 118, because the explosive material 104 is not embedded within the mine explosive 118.

The location sensing means 220 may comprise any configuration or material that will stop penetration of the projectile at the mine casing 116 as described above. The embodiment shown in FIG. 2*a* shows two tabs or alternatively, a circular tab protruding from the exterior of the body.

What is described are specific examples of many possible variations on the same invention and are not intended in a limiting sense. The claimed invention can be practiced using other variations not specifically described above.

What is claimed is:

1. A projectile for defeating a mine having a casing surrounding explosive material, comprising:

an elongated body;

a neutralizing agent at a first end;

a second explosive material at a second end;

a detonator proximate to the second explosive material; and, a backstop proximate to the detonator wherein the projectile penetrates through the casing and into the explosive material, deceleration causes the second explosive material to push into the detonator and the detonator to push against the backstop, activating the detonator, initiating the second explosive material, fracturing the explosive material without initiating the explosive material.

2. The projectile of claim 1, wherein the second explosive material comprises 77 percent HMX and 23 percent HTPB binder.

3. The projectile of claim 1, wherein the second explosive material comprises a weight ranging from about 1.5 grams to about 2 grams.

4. The projectile of claim 1, wherein the explosive material neutralizing agent is selected from the group of a surface contact chemical or a pyrotechnic mix material that will burn and consume the explosive material.

5. The projectile of claim 1, wherein the backstop comprises at least one tab protruding from an interior surface of the elongated body.

6. The projectile of claim 1, further comprising a location sensing means protruding from an outer surface of the elongated body.

7. A method of defeating a mine having a casing surrounding explosive material, comprising the steps of:

providing a projectile comprising an elongated body, a neutralizing agent at a first end, a second explosive material at a second end, a detonator proximate to the second explosive material, and, a backstop proximate to the detonator; and, propelling the projectile at the mine wherein the second end of the projectile penetrates through the casing and into the explosive material, deceleration causes the second explosive material to push into the detonator and the detonator to push against the backstop, activating the detonator, initiating the second explosive material, fracturing the explosive material without initiating the explosive material, and allowing the neutralizing agent to defeat the explosive material.

8. A method of defeating a mine having a casing surrounding explosive material, comprising the steps of:

providing a projectile comprising an elongated body, a neutralizing agent at a first end, a second explosive material at a second end, a detonator proximate to the second explosive material, a backstop proximate to the detonator, and a location sensing means protruding from an exterior surface of the elongated body; and, propelling the projectile toward the mine, wherein the first end of the projectile penetrates the casing into the explosive material, stopping when the location sensing means contacts the casing, causing the second explosive material to push into the detonator and the detonator to push against the backstop, activating the detonator, initiating the second explosive material, fracturing the explosive material without initiating the explosive material, and allowing the neutralizing agent to defeat the explosive material.

9. A projectile for defeating a mine having a casing surrounding explosive material, comprising:

an elongated body;

a neutralizing agent at a first end;

a second explosive material at a second end;

a detonator proximate to the second explosive material;

a location sensing means protruding from an exterior surface of the elongated body; and, a backstop proximate to the detonator wherein the first end of the projectile penetrates the casing into the explosive material, stopping when the location sensing means contacts the casing, causing the second explosive material to push into the detonator and the detonator to push against the backstop, activating the detonator, initiating the second explosive material, fracturing the explosive material without initiating the explosive material, and allowing the neutralizing agent to defeat the explosive material.

* * * * *